US009382056B1

(12) United States Patent
Hanna

(10) Patent No.: US 9,382,056 B1
(45) Date of Patent: Jul. 5, 2016

(54) CONTAINER WITH VENTED INTERMEDIATE SEPARATOR

(71) Applicant: Highland Packaging Solutions Inc., Plant City, FL (US)

(72) Inventor: Roger Hanna, Plant City, FL (US)

(73) Assignee: Highland Packaging Solutions, Inc., Plant City, FL (US)

( * ) Notice: Subject to any disclaimer, the term of this patent is extended or adjusted under 35 U.S.C. 154(b) by 0 days.

(21) Appl. No.: 14/872,407

(22) Filed: Oct. 1, 2015

(51) Int. Cl.

| | |
|---|---|
| ***B65D 81/02*** | (2006.01) |
| ***B65D 85/00*** | (2006.01) |
| ***B65D 81/28*** | (2006.01) |
| ***B65D 25/02*** | (2006.01) |
| ***B65D 43/16*** | (2006.01) |
| ***B65D 25/38*** | (2006.01) |
| ***B65D 85/32*** | (2006.01) |

(52) U.S. Cl.
CPC ..... *B65D 81/28* (2013.01); *B65D 25/02* (2013.01); *B65D 25/38* (2013.01); *B65D 43/16* (2013.01); *B65D 85/32* (2013.01)

(58) Field of Classification Search
CPC .. B65D 85/324; B65D 77/0413; B65D 85/32; B65D 85/322
USPC ..... 206/521–521.9, 203
See application file for complete search history.

(56) References Cited

U.S. PATENT DOCUMENTS

| | | | | |
|---|---|---|---|---|
| 2,655,305 | A * | 10/1953 | Schilling | B65D 85/324 206/521.8 |
| 3,000,528 | A * | 9/1961 | Kuhl | A01K 43/005 206/521.8 |
| 3,281,003 | A * | 10/1966 | Pesut, Jr. | B65D 1/36 206/521.1 |
| 7,205,016 | B2 * | 4/2007 | Garwood | A23B 4/10 426/108 |
| 7,258,234 | B2 | 8/2007 | Aardema | |
| 8,672,132 | B2 * | 3/2014 | Ramirez | B65D 85/34 206/521.1 |
| 8,999,415 | B2 | 4/2015 | Ramirez | |
| 2011/0226656 | A1 | 9/2011 | Archambault | |
| 2013/0264243 | A1 | 10/2013 | Aardema | |

* cited by examiner

*Primary Examiner* — Chun Cheung
(74) *Attorney, Agent, or Firm* — Fish & Richardson P.C.

(57) ABSTRACT

A container with a vented intermediate section, a base section, and a cover section. When the cover section is pivoted in the closed position a cover enclosure is formed between the intermediate section and the cover section, as are container receiving cavities. Interior vents fluidly couple the container receiving cavities with the cover enclosure.

16 Claims, 4 Drawing Sheets

CONTAINER WITH VENTED INTERMEDIATE SEPARATOR

BACKGROUND

Many food products are treated to remove or minimize the impact of potentially harmful bacteria that may be present on the surface of the food products. Often a gas agent that exhibits antimicrobial properties is used with certain food products to disinfect or even sterilize the surfaces of the food products. For eggs, for example, a gas agent may be used to disinfect the eggshell from bacteria present in the eggshell. One such gas agent is chlorine dioxide ($ClO_2$), which is an oxidizing agent that reacts with several cellular constituents of microbes.

After disinfecting, the food products are packed and shipped for distribution. For frangible objects, such as eggs, the food products are packed into egg cartons that are used for transportation to a grocer, display, and eventual storage after purchase by the consumer.

The disinfecting of the eggs prior to packaging is a food processing step that adds expense and time to egg processing.

SUMMARY

This specification describes technologies relating to a container with a vented intermediate separator that fluidly couples receiving cavities to a cover enclosure in the closed container. Within the cover enclosure may be affixed a label made of a polymeric material infused with a compound that releases a gas agent. By the fluid coupling of the vents, the gas agent enters the receiving cavities and reacts with the infecting agents, e.g., one or more of bacteria, viruses, fungi, etc., depending on the gas agent used, to disinfect the food product.

In general, one innovative aspect of the subject matter described in this specification can be embodied in a container apparatus that includes a base section, a cover section, and an intermediate section. The base section defines a base periphery and includes a base surface support structure within the base periphery and base receiving cavities extending from the base surface support structure. The cover section defines a cover periphery and is hingedly connected to a first edge of the base periphery for rotating between an open position and a closed position. The intermediate section defines an intermediate periphery and is hingedly connected to a second edge of the base periphery for rotating between an open position and a closed position. The intermediate section includes an intermediate surface support structure within the intermediate periphery, and intermediate receiving cavities extending from the intermediate surface support structure. The intermediate receiving cavities are in corresponding alignment with the base receiving cavities to form container receiving cavities when the intermediate section is pivoted in the closed position. The intermediate section includes one or more interior vents spaced apart from the intermediate periphery. When the cover section is pivoted in the closed position, a cover enclosure is formed between the intermediate section and the cover section and the respective base periphery, intermediate periphery and the cover periphery. The one or more interior vents fluidly couple the container receiving cavities with the cover enclosure.

Particular embodiments of the subject matter described in this specification can be implemented so as to realize one or more of the following advantages. The vented intermediate separator facilitates the passive venting of the gas agent released from the label into the receiving cavities, which eliminates a separate disinfecting food processing step. This reduces overall food processing time and costs. Side vents in the container allow for passive exhaust venting of the gas agent into the atmosphere, and are sized such that the time required for the passive venting is sufficient to ensure the efficacy of the gas agent. This further reduces processing costs by eliminating the need for an active venting process step, e.g., such as by subjecting the containers to an air blower to facilitate active venting within the container.

The details of one or more embodiments of the subject matter described in this specification are set forth in the accompanying drawings and the description below. Other features, aspects, and advantages of the subject matter will become apparent from the description, the drawings, and the claims.

BRIEF DESCRIPTION OF THE DRAWINGS

Like reference numbers and designations in the various drawings indicate like elements.

DETAILED DESCRIPTION

Figure 1:
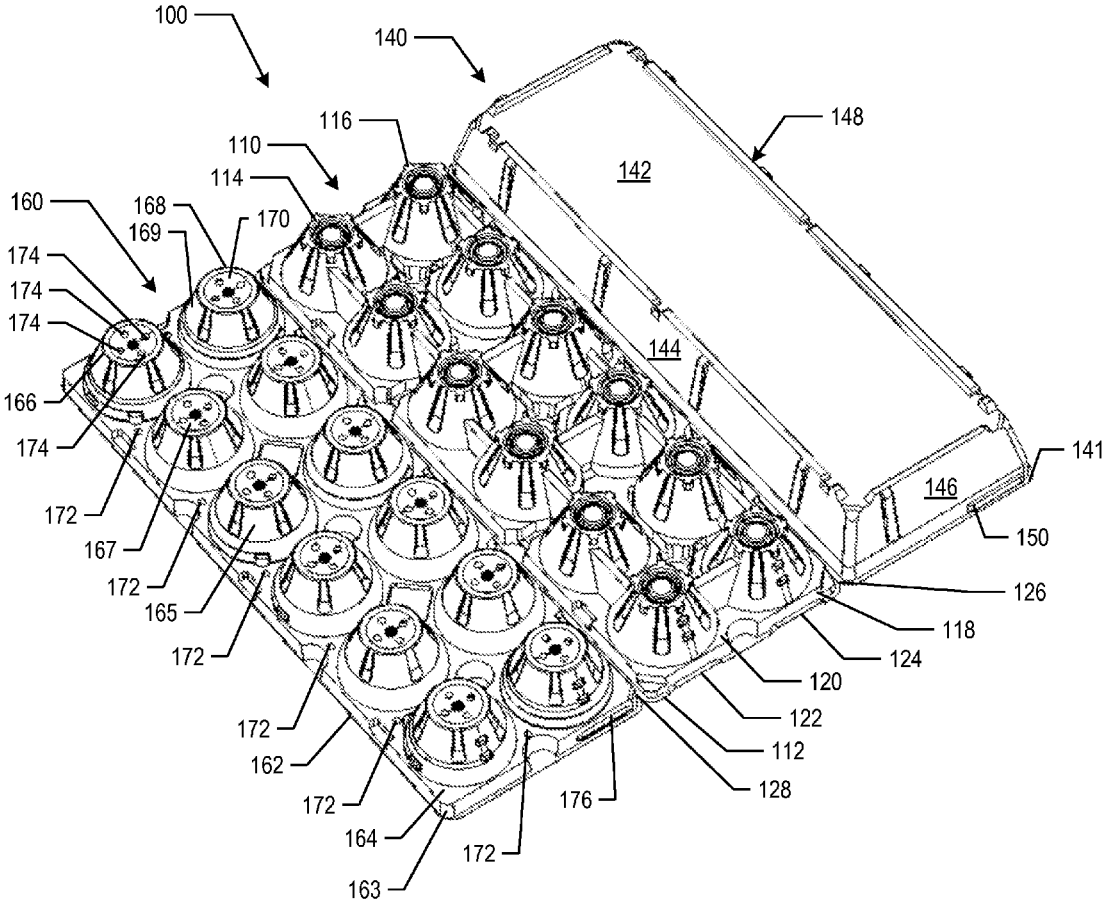
FIG. 1 is a top perspective view of a container with a vented intermediate separator.

FIG. 1 is a top perspective view of a container 100 with a vented intermediate separator 160, which is also referred to as an intermediate section 160. The container 100 is also described with reference to FIGS. 2 and 3, which depict top and side views of the container 100, respectively, and FIG. 4, which depicts a side view of the container 100 in a closed position.

While many features of the container 100 depicted in the drawings are described, descriptions of some structures depicted in the drawing are omitted for brevity. Furthermore, numbering of like features is omitted to avoid congestion in the drawings.

With reference to FIG. 1, the container includes a base section 110 defining a base periphery 112. The base section 110 has a base surface support structure 120, which, in the example shown in FIGS. 1-4, constitutes a raised surface 120 relative to the base periphery 112. The base surface support structure 120 is offset from the periphery 112 by sidewalls 118.

Figure 4:
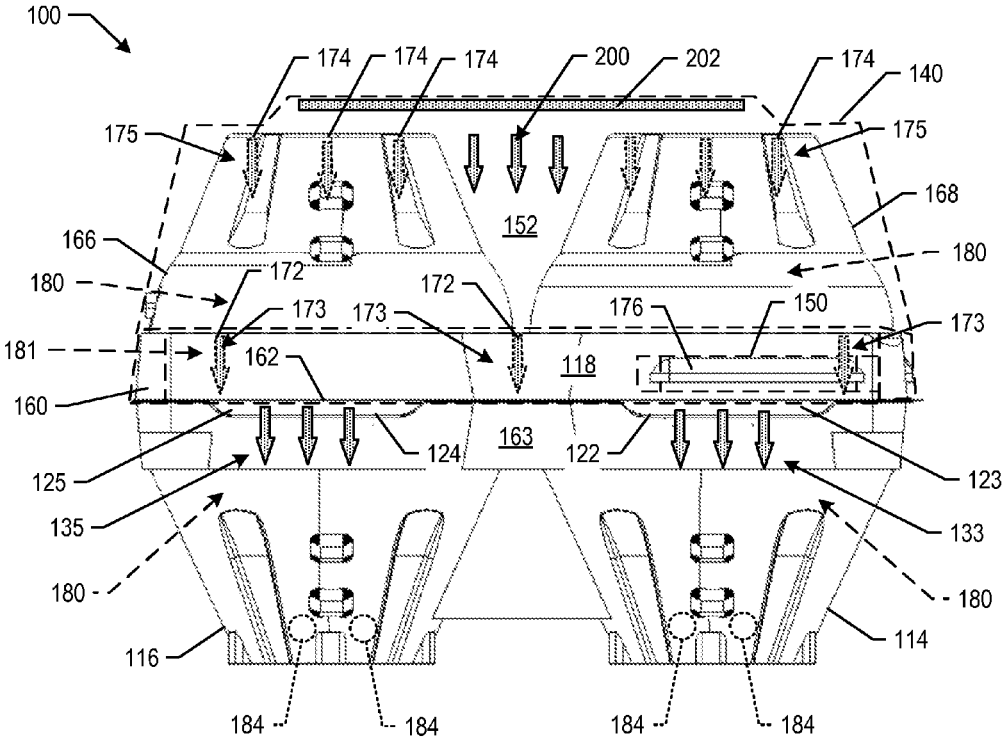
FIG. 4 is a side view of the container in a closed position, with a cover section shown in phantom.

Extending from the base surface 120 are receiving cavities 114 and 116. The receiving cavities 114 and 116 form the bottom portions of two respective rows of container receiving cavities 180 when the container 100 is in a closed position as depicted in FIG. 4, and will be described in more detail below.

Figure 2:
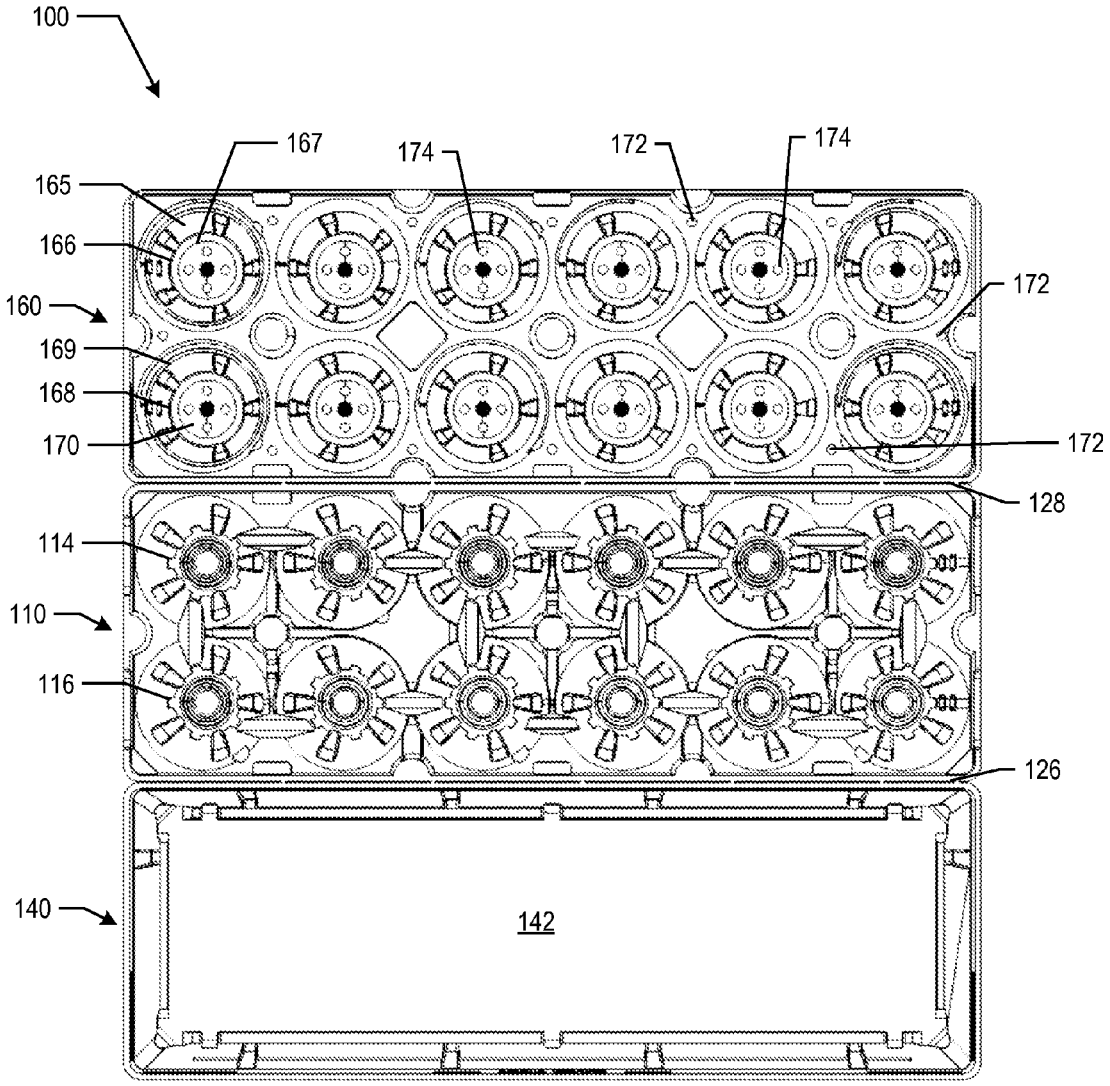
FIG. 2 is a top view of the container.

A cover section 140 defines a cover periphery 141 and is hingedly connected to a first edge 126 of the base periphery 112 for rotating between an open position and a closed position. In some implementations, the first edge 126 to which the cover section 140 is connected is a living hinge, which is also shown in FIG. 2. Other pivotal connections can also be used.

The cover section 140 includes a top portion 142 and sidewalls, e.g., 144, 146 and 148. The cover section 140 also includes a first projection 150 that is operatively associated with a second projection 176 on the intermediate section 160 and that locks the cover section 140 into the closed position, as will be described with reference to FIG. 3.

The intermediate section 160 defines an intermediate periphery 162 and is hingedly connected to a second edge 128 of the base periphery 112 for rotating between an open position and a closed position. In some implementations, the second edge 128 to which the cover section 140 is connected is a living hinge, which is also shown in FIG. 2. Other pivotal connections can also be used.

The intermediate section 160 has an intermediate surface support structure 164, which, in the example shown in FIGS. 1-4, constitutes a raised surface 164 relative to the intermediate periphery 162. The intermediate support structure 164 is offset from the periphery 162 by sidewalls 163.

Intermediate receiving cavities 166 and 168 extend from the intermediate surface support structure 164 and are in corresponding alignment with the base receiving cavities 116 and 114, respectively, to form container receiving cavities 180 when the intermediate section 140 is pivoted in the closed position. The receiving cavities 166 and 168 are formed by circumferential sidewalls 165 and 169 of decreasing radius that terminate in top surfaces 167 and 170.

Due to the sidewalls 118 and 163, an intermediate cavity 181 is also formed in connection with the container receiving cavities 180 when the container 100 is in the closed position, as shown in FIG. 4. The intermediate cavity 181 helps facilitate fluid coupling to the lower portions of the container receiving cavities 180 formed by the receiving cavities 114 and 116, and also facilitates venting to the outside atmosphere by exterior vents 123 and 125, which will be described in more detail below.

The intermediate section 160 also includes one or more interior vents that are spaced apart from the intermediate periphery 162. As shown in FIGS. 1 and 2, first interior vents 172 are formed in the intermediate support surface structure 164. Although depicted as being proximately disposed from the receiving cavities 166 and 168 and near, but spaced apart from, the outer periphery 162, the vents 172 can also be located at other positions on the intermediate support surface 164. And while also depicted as round holes, the vents 172 can be of other shapes, such as square holes, and even openings that are asymmetric with respect to an opening centroid.

In the example shown in FIGS. 1 and 2, the top surface 167 and 170 of each intermediate receiving cavity 166 and 168 includes vents 174, which are likewise spaced apart from the outer periphery 162. While four vents 174 are shown in each top surface 167 and 170, more or fewer vents 174 may be formed. Also, while depicted as round holes, the vents 174 can be of other shapes, such as square holes, and even openings that are asymmetric with respect to an opening centroid.

When the intermediate section 160 and the cover section 110 are pivoted in the closed position, a cover enclosure 152 is formed between the intermediate section 160 and the cover section 140. The cover enclosure 152 is shown in FIG. 4, and is defined by the space between the walls and top of the cover section 140 and the surfaces of the intermediate support surface 164 and the receiving cavities 166 and 168.

The vents 172 and 174 fluidly couple the cover enclosure 152 to the container receiving cavities 180 and the intermediate cavity 181. The fluid coupling is illustrated in FIG. 4 by the phantom flow arrows 173 for vents 172 and the phantom flow arrows 175 for vents 174.

Figure 3:
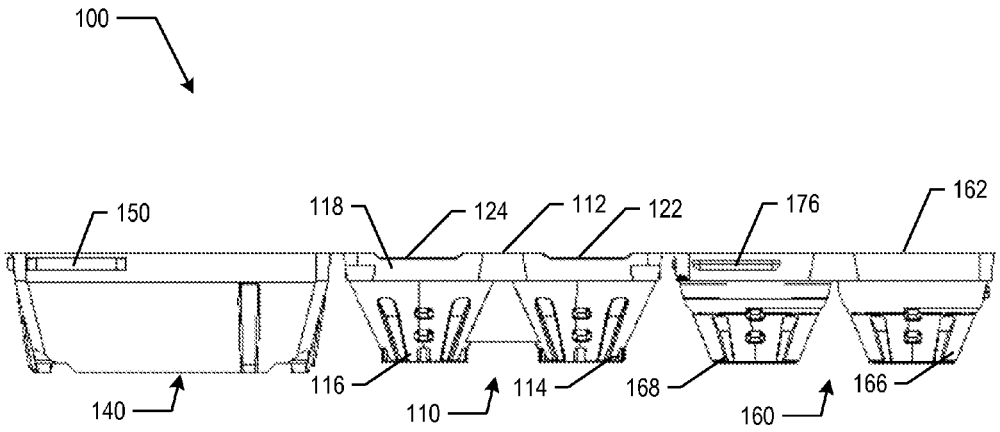
FIG. 3 is a side view of the container.

To form the exterior vents 123 and 125, the base periphery 112 includes recessed portions 122 and 124 that reduce the overall height of the sidewall 118, as shown in FIG. 3. When the intermediate section 160 and the cover section 110 are pivoted in the closed position, the sections of the sidewall 118 that are reduced in height by the recessed portions 122 and 124 form exterior vents 123 and 125 that couple the intermediate cavity 181 to the atmosphere outside the closed container 100. This fluid coupling is indicated by flow arrows 133 and 135, respectively.

Although only two exterior vents are shown in FIG. 4, additional exterior vents may be formed on the opposite side of the container 100. Furthermore, in some implementations, exterior vents, such as vents 184, may be formed in the bottoms of the base receiving cavities 114 and 116 in addition to, or instead of, the exterior vents 123 and 125.

The venting described above facilitates the distribution of a gas agent 200 from within the cover enclosure 152. The gas agent 200 is used to disinfect food objects that are stored in the container receiving cavities 180. As shown in FIG. 4, a label 202 made of a polymeric material is attached to the bottom side of the top surface 142 of the cover portion 140. The label 202 is infused with a compound that releases the gas agent 200. By the fluid coupling of the vents 172 and/or 174, the gas agent 200 enters the container receiving cavities 180 and the intermediate cavity 181 and reacts with the infecting agents, e.g., one or more of bacteria, viruses, fungi, etc., depending on the gas agent used, to disinfect the food product. The gas agent 200 can vent out from the intermediate cavity 181 by the exterior vents 123 and 125 (and/or vents 184).

The vents 123 and 125 (and/or 184) are sized so that passive venting is constrained to ensure efficacy of a gas agent reaction of the gas agent 200 occurring within the container receiving cavities 180. For example, assume a particular gas agent is required to be at a minimum concentration X for Y minutes in the container receiving cavities 180 to be effective. The size of the exterior vents are selected to ensure that passive venting to the atmosphere outside the container 100 is constrained enough to ensure that the concentration within the container receiving cavities 180 is at least the minimum concentration X for Y minutes. The selection can be based on empirical evaluations, or calculated based fluid dynamic models and then verified.

In some implementations, the container 100 is made of polyethylene terephthalate (PET) thermoplastic polymer resin. The container may be clear so that the affixed label 202 also serves to brand the food products. Alternatively, the container may be opaque.

Furthermore, other plastic materials may also be used to form the container 100. Alternatively, a paper product or extruded polystyrene foam maybe used to form the container 100.

Although the container 100 is described with the intermediate section 160 and cover section 140 being connected to opposite sides of the base section 110, the intermediate section 160 and cover section 140 may instead be connected to adjacent sides of the base section 110. For example, the cover section 140 may be connected as shown in FIG. 1, but intermediate section 160 may be connected to one of the sides that are adjacent to the cover section 140 and fold lengthwise instead of sideways.

Furthermore, the base section 110, cover section 140 and intermediate section 160 need not be formed from a contiguous piece of material. Instead, the three sections 110, 140 and 160 may be separate pieces that are not connected to each other.

Figure 5:
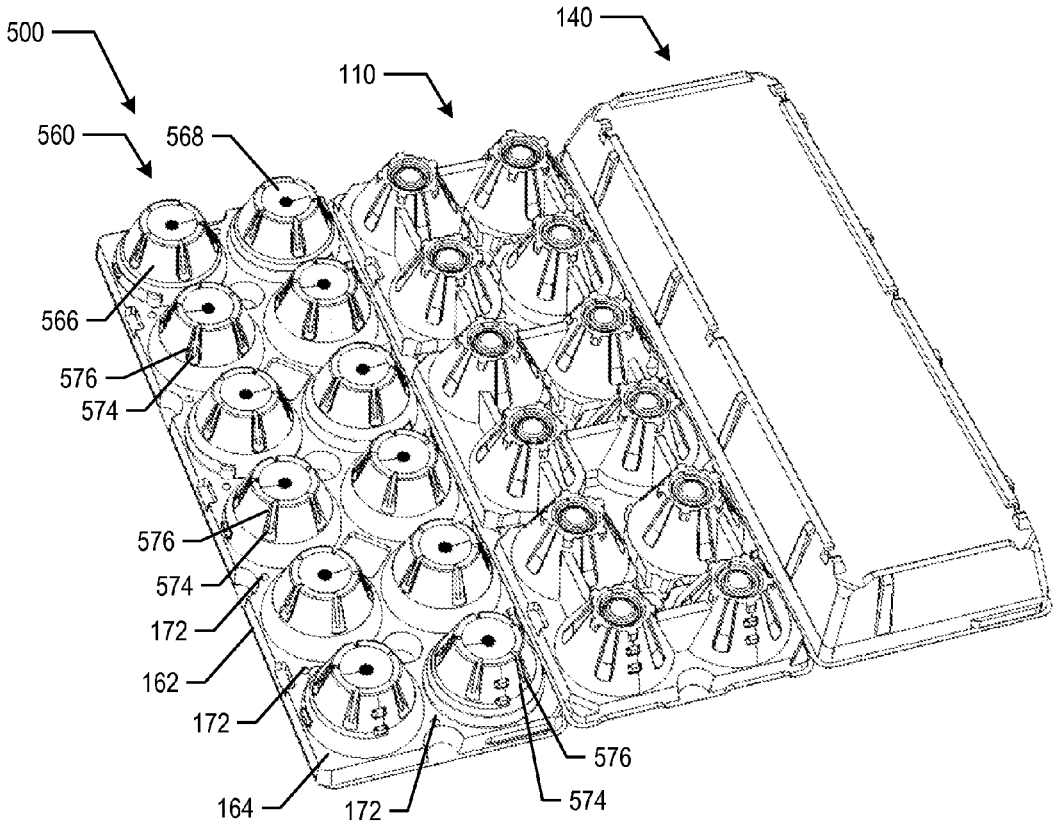
FIG. 5 is a top perspective view of another implementation of a container with a vented intermediate separator.

Finally, as described above, other forms of vents may be used. For example, FIG. 5 illustrates a top perspective view of another implementation of a container 500 with a vented intermediate separator 560 that includes intermediate receiving cavities 566 and 568. In the side walls of the intermediate receiving cavities 566 and 568 are ribbed formations 576 that provide structural support. However, in this implementation, a central channel is removed from the center of each ribbed formation 576 to form an interior vent 574 along the side wall that extends to the top surface of each receiving cavity 566 and 568. Other venting designs may also be used in the intermediate section 160.

While this specification contains many specific implementation details, these should not be construed as limitations on the scope of any features or of what may be claimed, but rather as descriptions of features specific to particular embodiments. Certain features that are described in this specification in the context of separate embodiments can also be implemented in combination in a single embodiment. Conversely, various features that are described in the context of a single embodiment can also be implemented in multiple embodiments separately or in any suitable subcombination. Moreover, although features may be described above as acting in certain combinations and even initially claimed as such, one or more features from a claimed combination can in some cases be excised from the combination, and the claimed combination may be directed to a subcombination or variation of a subcombination.

Thus, particular embodiments of the subject matter have been described. Other embodiments are within the scope of the following claims. In some cases, the actions recited in the claims can be performed in a different order and still achieve desirable results. In addition, the processes depicted in the accompanying figures do not necessarily require the particular order shown, or sequential order, to achieve desirable results. In certain implementations, multitasking and parallel processing may be advantageous.

What is claimed is:

1. A container apparatus, comprising:

a base section defining a base periphery and including:

a base surface support structure within the base periphery; and base receiving cavities extending from the base surface support structure;

a cover section defining a cover periphery and hingedly connected to a first edge of the base periphery for rotating between an open position and a closed position; and an intermediate section defining an intermediate periphery and hingedly connected to a second edge of the base periphery for rotating between an open position and a closed position, and including:

an intermediate surface support structure within the intermediate periphery;

intermediate receiving cavities extending from the intermediate surface support structure and that are in corresponding alignment with the base receiving cavities to form container receiving cavities when the intermediate section is pivoted in the closed position; and one or more interior vents defined in the intermediate section and spaced apart from the intermediate periphery; and wherein:

respective portions of the base periphery, intermediate periphery and cover periphery align when the intermediate section and the cover section are in the closed position to form one or more exterior vents that fluidly couple the container receiving cavities to an atmosphere exterior to the container apparatus;

when the cover section is pivoted in the closed position a cover enclosure is formed between the intermediate section and the cover section and the respective base periphery, intermediate periphery and cover periphery, and the one or more interior vents fluidly couple the container receiving cavities with the cover enclosure so that a venting of a gas agent emanating from within the cover enclosure to the atmosphere exterior to the container apparatus vents from the cover enclosure to the container receiving cavities through the one or more interior vents, and vents from the container receiving cavities to the atmosphere through the one or more exterior vents; and wherein the one or more exterior vents are sized so that passive venting to the atmosphere of the gas agent entering the container receiving cavities from the cover enclosure through the one or more interior vents is constrained so that at least a minimum concentration of the gas agent is maintained in the container receiving cavities for an amount of time that ensure efficacy of a gas agent reaction occurring within the container receiving cavities.

2. The apparatus of claim 1, wherein the gas agent is chlorine dioxide.

3. The apparatus of claim 1, wherein the one or more interior vents defined in the intermediate section comprise interior vents formed in the intermediate support surface structure.

4. The apparatus of claim 3, wherein interior vents formed in the intermediate support surface structure comprise at least one interior vent in corresponding proximate disposition to each intermediate receiving cavity.

5. The apparatus of claim 3, wherein each intermediate receiving cavity comprises a sidewall and a top surface, and each intermediate receiving cavity includes an interior vent in the side wall.

6. The apparatus of claim 5, wherein each intermediate receiving cavity further includes an interior vent in the top surface.

7. The apparatus of claim 1, wherein each intermediate receiving cavity comprises a sidewall and a top surface, and wherein the one or more interior vents defined in the intermediate section comprise interior vents formed in the sidewalls of the intermediate receiving cavity.

8. The apparatus of claim 1, wherein each intermediate receiving cavity comprises a sidewall and a top surface, and wherein the one or more interior vents defined in the intermediate section comprise interior vents formed in the top surfaces of the intermediate receiving cavity.

9. The apparatus of claim 1, wherein the one or more interior vents defined in the intermediate section comprise interior vents formed in the intermediate support surface structure.

10. The apparatus of claim 9, wherein the interior vents formed in the intermediate support surface structure comprise at least one interior vent in corresponding proximate disposition to each intermediate receiving cavity.

11. The apparatus of claim 10, wherein each intermediate receiving cavity comprises a sidewall and a top surface, and each intermediate receiving cavity includes an interior vent in the side wall.

12. The apparatus of claim 11, wherein each intermediate receiving cavity further includes an interior vent in the side wall.

13. The apparatus of claim 1, wherein each intermediate receiving cavity comprises a sidewall and a top surface, and wherein the one or more interior vents defined in the intermediate section comprise interior vents formed in the sidewalls of the intermediate receiving cavity.

14. The apparatus of claim 1, wherein each intermediate receiving cavity comprises a sidewall and a top surface, and wherein the one or more interior vents defined in the intermediate section comprise interior vents formed in the top surfaces of the intermediate receiving cavity.

15. The apparatus of claim 1, wherein the base surface and the intermediate surface are spaced apart when the intermediate section is pivoted in the closed position form a base enclosure that fluidly couples the container receiving cavities formed when the intermediate section is pivoted in the closed position.

16. A container apparatus, comprising:

a base section defining a base periphery and including:

a base surface support structure within the base periphery; and base receiving cavities extending from the base surface support structure;

a cover section defining a cover periphery and hingedly connected to a first edge of the base periphery for rotating between an open position and a closed position; and an intermediate section defining an intermediate periphery and hingedly connected to a second edge of the base periphery for rotating between an open position and a closed position, and including:

an intermediate surface support structure within the intermediate periphery;

intermediate receiving cavities extending from intermediate surface support structure and that are in corresponding alignment with the base receiving cavities to form container receiving cavities when the intermediate section is pivoted in the closed position; and wherein when the cover section is pivoted in the closed position a cover enclosure is formed between the intermediate section and the cover section and the respective base periphery, intermediate periphery and cover periphery; and further comprising:

first means for fluidly coupling the container receiving cavities to an atmosphere exterior to the container apparatus;

second means for fluidly coupling couple the container receiving cavities to the cover enclosure; and wherein the first means for fluidly coupling the container receiving cavities to an atmosphere exterior to the container apparatus and the second means for fluidly coupling the container receiving cavities to the cover enclosure are operatively sized so that passive venting of a gas agent emanating from within the cover enclosure to the atmosphere exterior to the container apparatus, wherein the passive venting vents from the cover enclosure to the container receiving cavities through the second means for fluidly coupling, and vents from the container receiving cavities to the atmosphere through the first means for fluidly coupling, is constrained so that at least a minimum concentration of the gas agent is maintained in the container receiving cavities for an amount of time that ensure efficacy of a gas agent reaction occurring within the container receiving cavities.

* * * * *